United States Patent [19]

Holmberg

[11] Patent Number: 4,632,299

[45] Date of Patent: Dec. 30, 1986

[54] RECLOSABLE CONTAINER

[76] Inventor: Albert E. Holmberg, 5316 Interlachen Blvd., Edina, Minn. 55436

[21] Appl. No.: 740,412

[22] Filed: Jun. 3, 1985

[51] Int. Cl.[4] ..... B65D 43/00

[52] U.S. Cl. ..... 229/7 R; 206/626; 206/813; 229/17 R

[58] Field of Search ..... 229/7 R, 17 R, 37 R, 229/45 R; 206/813, 206, 607, 611, 626, 620, 621, 628; 383/66

[56] References Cited

U.S. PATENT DOCUMENTS

| | | | |
|---|---|---|---|
| 1,915,503 | 6/1933 | Schmidt | 206/813 |
| 2,226,049 | 12/1940 | Carley | 229/7 R |
| 2,400,406 | 5/1946 | Godoy | 229/45 R |
| 2,738,916 | 3/1956 | Peters | 229/7 R |
| 2,776,787 | 1/1957 | Nicol | 229/7 R |
| 2,896,839 | 7/1959 | Barnes et al. | 206/626 |
| 3,195,283 | 7/1965 | Broersma | 383/66 |
| 3,301,458 | 1/1967 | Rausing et al. | 229/7 R |
| 3,306,521 | 2/1967 | Giacovas | 229/45 R |
| 3,687,352 | 8/1972 | Kalajian | 229/7 R |
| 3,711,011 | 1/1973 | Kugler | 229/7 R |

FOREIGN PATENT DOCUMENTS

| | | | |
|---|---|---|---|
| 1562718 | 2/1969 | France | 229/17 R |
| 417465 | 2/1967 | Switzerland | 229/45 R |
| 1022146 | 3/1966 | United Kingdom | 229/17 R |
| 2045723 | 11/1980 | United Kingdom | 229/17 R |

*Primary Examiner*—William Price
*Assistant Examiner*—Gary E. Elkins
*Attorney, Agent, or Firm*—John W. Adams

[57] ABSTRACT

A reclosable container provided with a dispensing opening having an overlying closure flap with a pressure-sensitive tape extending therearound to permit removable attachment to the portion of the container surrounding the opening.

3 Claims, 5 Drawing Figures

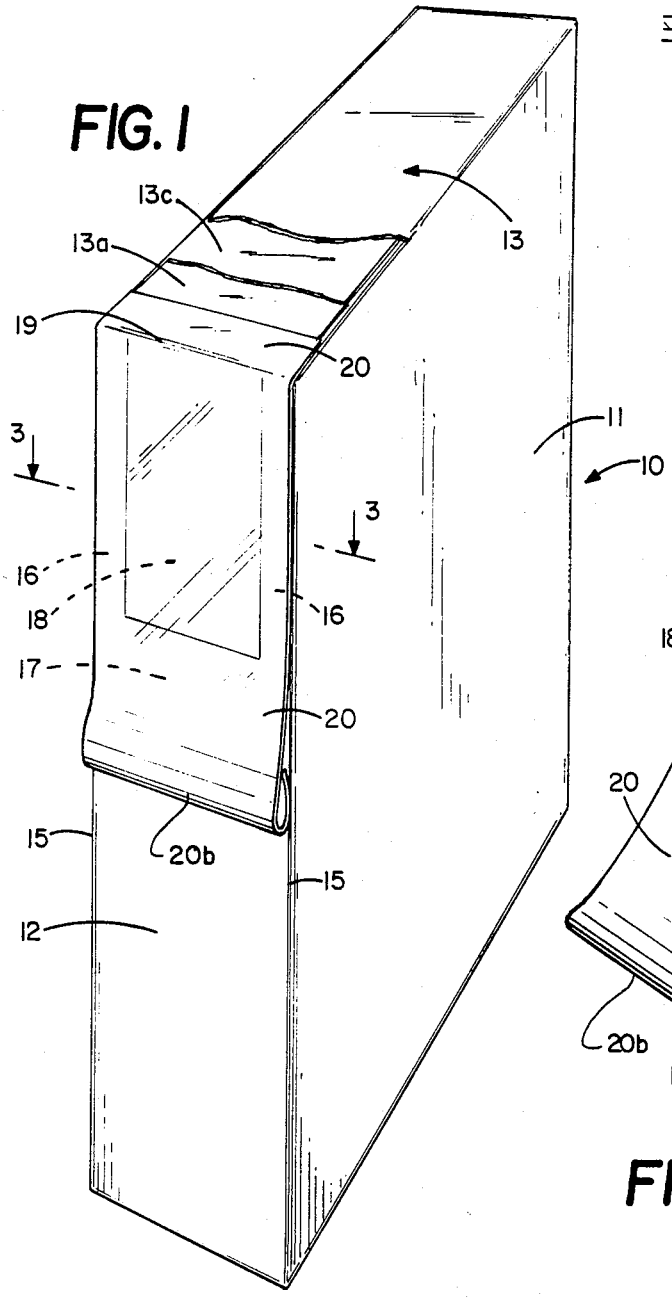
FIG. 1
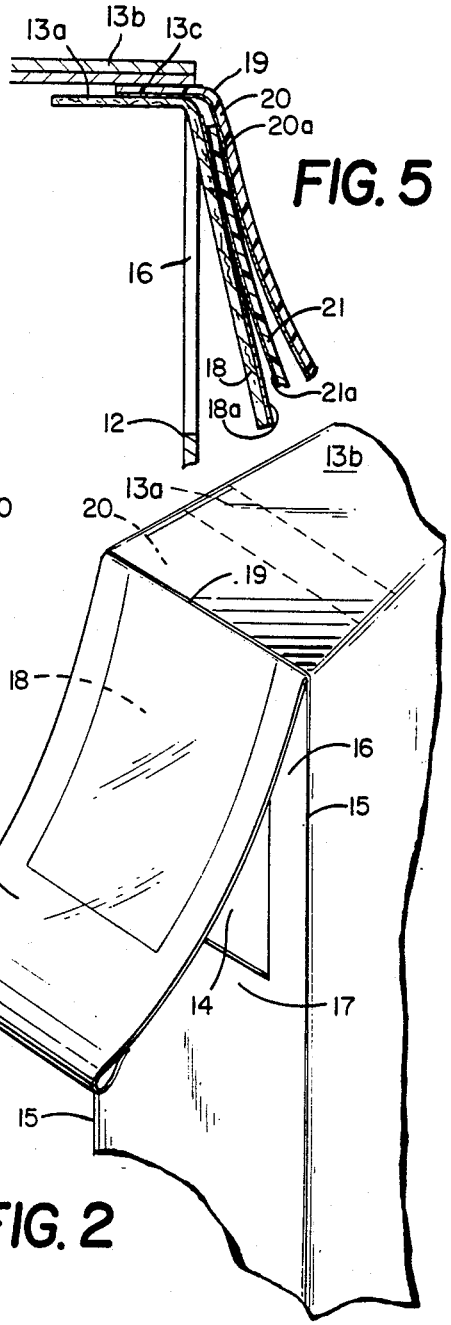
FIG. 5
FIG. 2
FIG. 3
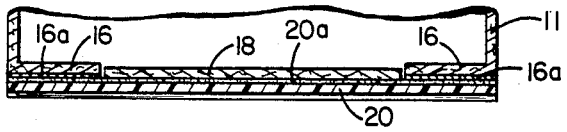
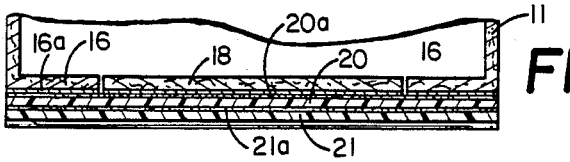
FIG. 4

RECLOSABLE CONTAINER

SUMMARY OF THE INVENTION

This invention comprises a reclosable container which permits repeated, substantially air-tight resealing of the content discharge opening of the container. This is accomplished by the use of a pressure-sensitive closure tape adapted to provide a peripheral seal around a dispensing closure flap of the container and produce a positive, substantially air-tight closure between the tape surrounding the flap and the marginal edge portion of the container surrounding the discharge opening. The area surrounding said opening is provided with a conventional adhesive repellant or a layer of protective tape having a repellant coating on the back side thereof to permit repeated engagement of the pressure-sensitive adhesive coating of the closure tape without delaminating the portion of the container surrounding said opening.

DESCRIPTION OF THE DRAWINGS

FIG. 1 is a perspective view showing a box-like container embodying this invention with the closure flap in sealed position;

FIG. 2 is a similar view of the flap partially open;

FIG. 3 is a vertical sectional view of the invention shown in FIG. 1;

FIG. 4 is a sectional view of a modified form of the invention; and

FIG. 5 is a sectional view of the form shown in FIG. 4 with the flap and tape assembly in open position and the bottom tape partially separated from the outer tape and the flap.

DETAILED DESCRIPTION OF THE PREFERRED EMBODIMENT

A conventional packaging carton for products such as cereal and the like is shown in the accompanying drawings and is designated by the numeral 10. The carton 10 has a front panel 11 and edge panel 12 and a top closure flap assembly 13 which is illustrated in closed, sealed position as by being permanently glued in a conventional manner. The bottom of the carton (not shown) is also sealed in the same manner as the to assembly 13 and the back and other edge panels (not shown) are also of conventional construction. The top closure flap assembly 13 includes a pair of end flaps **13*a*, a front flap 13*b* and a back flap 13*c* as best shown in FIG. 1**.

A discharge opening 14 is formed in the upper portion of the illustrated edge panel 12 in spaced relation to the corners 15 of the carton to form flap attachment portions 16 along the sides of the opening. A flap attachment portion 17 is also formed adjacent the bottom of the opening as illustrated. The upper edge of the cut-out portion of the box 18 is left attached to the top of the box edge 12 to form a hinge connection at the fold line 19 of the carton. An end closure flap **13*a* forming a part of the top closure assembly 13 is hinged along the fold line 19**.

A closure tape 20 having a pressure-sensitive adhesive layer **20*a* is permanently adhered to the top surface of the end flap 15*a* and extends around the fold line 19 and downwardly therefrom to overlie the flap 18, the attachment portions 16 and 17, and is provided with a doubled back gripping tab portion 20*b* at the bottom thereof. The tape extends laterally outwardly beyond the side edges of the flap 18 to overlie the side attachment portions 16 as indicated above, and is provided with a pressure-sensitive adhesive coating on the bottom side thereof which removably attaches to the side attachment portions 16 and the bottom attachment portion 17**.

All pressure-sensitive tapes have a repellant coating applied to the back side thereof to prevent delamination of the pressure-sensitive adhesive layer from the body of the tape when the tape is in the form of a dispensing roll. The side attachment portions 16 and the bottom attachment portion 17 of the edge panel 12 of the box are provided with a coating **16*a*** of suitable adhesive repellant to prevent delamination of the box during repeated opening and resealing of the closure flap. This can be accomplished by the application of a conventional protective pressure-sensitive tape layer (not shown) which has the repellant coating already applied thereto.

A modified form of the invention is illustrated in FIG. 4 where a double layer of tape is provided. A removable under layer of pressure-sensitive tape 21 having a pressure-sensitive adhesive **21*a* is applied to the under side of the tape 20 and the upper edge thereof terminates a slight distance below the fold line 19 to permit removal of the under tape layer 21 and expose a fresh adhesive closure surface in the event that the original adhesive surface provided by the under tape layer 21 loses its adhesive properties by an accumulation of dust or product on the adhesive surface thereof. The back side of the under tape layer 21 includes a repellant to facilitate separation and removal of the tape layer 21 from the overlying outer tape adhesive surface 20*a*. Also, in order to facilitate removal of the under tape layer 21, the outer surface of the flap 18 must be provided with a suitable adhesive repellant layer 18*a* to facilitate removal of the under tape layer 21** from the flap without delaminating the flap.

It is to be understood that while there has been illustrated and described certain forms of the present invention, the invention is not to be limited to the specific form or arrangement of parts herein described and shown except to the extent that such limitations are found in the claims.

What is claimed is:

1. A reclosable container comprising, a container body including side panels and top and bottom panels, all interconnected after filling to sealingly enclose a product therewithin, one of said panels having a discharge opening formed therein with a closure flap hinged at a peripheral portion of said opening, panel portions surrounding said opening to provide flap attachment portions, reusable, pressure-sensitive adhesive tape connected to the hinged closure flap and overlying said attachment panel portions when said flap is in closed position to combine with said flap to removably, sealingly close said opening, said attachment panel portions having an adhesive repellant layer on the surface to permit sealing enagement with the pressure-sensitive adhesive tape but permitting removal of the tape from the attachment portions without delaminating the panel surface, and a second reusable pressure-sensitive adhesive tape having an adhesive repellant on the back side thereof and removably applied to the first mentioned tape and being of substantially equal width therewith and removably adhered to the outer surface of said flap to permit separation therefrom and removal from the under side of the outer tape to expose a fresh adhesive surface for continued resealing between the exposed adhesive surfaces of the outer tape and the flap attachment portions of the container.

2. The structure set forth in claim 1 and the closure flap of the container having an adhesive repellant outer surface to permit removal of the under tape layer without delamination of the flap.

3. The structure set forth in claim 1 and both tape layers being provided with a gripping tab to facilitate removal thereof.

* * * * *